US007929872B2

(12) United States Patent
Gross et al.

(10) Patent No.: US 7,929,872 B2
(45) Date of Patent: Apr. 19, 2011

(54) XEROGRAPHIC PROCESS CONTROLS SCHEDULING APPROACH TO MITIGATE COSTS OF MEASUREMENT

(75) Inventors: Eric M Gross, Rochester, NY (US); Palghat S Ramesh, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 57 days.

(21) Appl. No.: 12/512,053

(22) Filed: Jul. 30, 2009

(65) Prior Publication Data

US 2011/0026945 A1 Feb. 3, 2011

(51) Int. Cl.
*G03G 15/00* (2006.01)
*G03G 15/08* (2006.01)

(52) U.S. Cl. ..... 399/27; 399/49

(58) Field of Classification Search ..... 399/27, 399/49, 72, 38, 44
See application file for complete search history.

(56) References Cited

U.S. PATENT DOCUMENTS

| | | | | |
|---|---|---|---|---|
| 5,543,896 | A | 8/1996 | Mestha | |
| 5,887,221 | A | 3/1999 | Grace | |
| 5,903,797 | A | 5/1999 | Daniels et al. | |
| 6,169,861 | B1 * | 1/2001 | Hamby et al. | 399/27 X |
| 6,272,295 | B1 | 8/2001 | Lindblad et al. | |
| 2004/0213593 | A1 * | 10/2004 | Brewington et al. | 399/27 |
| 2005/0244172 | A1 * | 11/2005 | Kreckel | 399/27 |
| 2009/0202263 | A1 * | 8/2009 | Yoshida et al. | 399/49 |

* cited by examiner

*Primary Examiner* — Sophia S Chen

(57) ABSTRACT

A method and apparatus for maintaining color consistency includes varying a sampling interval to balance the benefit of xerographic process controls regulation with the cost of sampling. The request to sample is triggered by external indicators (area coverage, carrier age, relative humidity, temperature, etc.). Before the developed mass is expected to go out of range because of the external indicators, a patch measurement is made and the system is controlled back towards its desired set-point.

20 Claims, 2 Drawing Sheets

XEROGRAPHIC PROCESS CONTROLS SCHEDULING APPROACH TO MITIGATE COSTS OF MEASUREMENT

This disclosure relates in general to an image forming apparatus, and more particularly, to an image forming apparatus employing an improved approach to controlling the xerographic process at reduced costs.

Sampling developed patches for purpose of xerographic controls is costly, but it is performed nevertheless since the benefit provided by feedback (color stability, performance latitude) out weigh the costs. Typically, the sampling period is fixed for a control system. This is often advantageous in terms of implementation ease, as well as, in analysis. Sampling costs are due primarily to toner waste and productivity loss. With respect to toner waste, the toner used for process control patches ultimately is sent to the waste collection bottle. And for productivity loss, some imaging forming procedures require dead cycling since the customer image area is use or since toner may not be transferred to paper multiple cleaning cycles may be required. For example, in some image forming products that employ intermediate belts, the second transfer is cammed away from the intermediate belt to prevent a transfer roll from becoming contaminated. This may result in an interruption on printing every two to three minutes. Thus, it is desirable to minimize the cost of sampling yet maintain the benefits of feedback.

As disclosed in U.S. Pat. No. 5,887,221 and U.S. Pat. No. 5,543,896, the use of sensors in a xerographic engine to detect the toner mass levels on a photoreceptor, or other substrate, in a post-development position (detection of developed mass) is known. The use of sensors to detect residual toner mass levels post-cleaning device is also described in U.S. Pat. No. 6,272,295 and U.S. Pat. No. 5,903,797. It is also known to measure the residual mass after transfer, but before the cleaning device (post-transfer residual mass).

Previous post-transfer residual mass sensors provided information about the average transfer efficiency or of developed mass on the photoreceptor or drum that is rendered between sheets so it is not transferred, and could enable limited closed loop control of xerographic transfer system. For example, use of an Extended Toner Area Coverage (ETAC) sensor to measure residual mass during xerographic set-up. The data from an ETAC sensor was used to adjust a transfer process current set point or other parameter, to obtain optimal performance prior to the submission of a customer's job.

While disclosures of the above-mentioned patents are useful, there is still a need for maintaining color consistency with test patches while simultaneously minimizing the costs of sampling with those patches.

Accordingly, a sampling method is disclosed for maintaining color consistency that includes varying a sampling interval to balance the benefit of xerographic process controls regulation with the cost of sampling. The request to sample is triggered by external indicators. Some a priori understanding of the sensitivity of developed mass to the external indicators that may be measured or estimated, (area coverage, carrier age, relative humidity, temperature, etc.) is needed to trigger the sample measurement. Before the developed mass is expected to go out of range because of the external indicators, a patch measurement is made and the system is controlled back towards its desired set-point.

The disclosed reprographic system that incorporates the disclosed improved method for maintaining color consistency in a printer may be operated by and controlled by appropriate operation of conventional control systems. It is well-known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposes or inserters to add covers or other inserts to the compiled sets.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
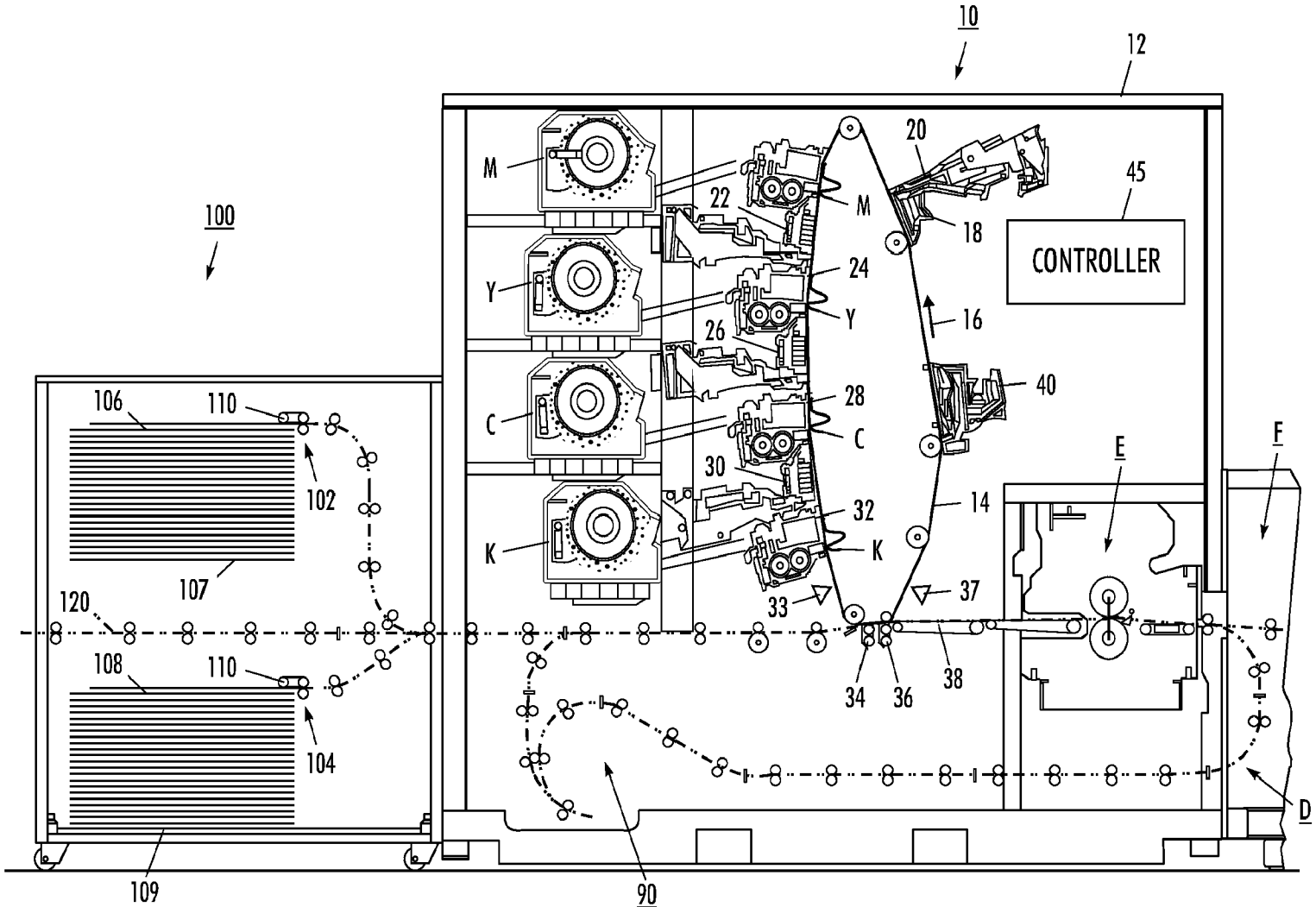
FIG. 1 is a partial, frontal view of an exemplary modular xerographic printer that includes the xerographic process controls scheduling approach of the present disclosure.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes a method and apparatus for sensor calibration and processing to obtain transfer efficiency measurements.

For a general understanding of the features of the disclosure, reference is made to the drawings. In the drawings, like reference numerals have been used throughout to identify identical elements.

Referring now to printer 10 in the figure, as in other xerographic machines, and as is well known, shows an electrographic printing system including the improved method and apparatus where color consistency is maintained in the printer by printing and measuring color patches at regular intervals and changing subsystem set-points to maintain the printer performance in accordance with the present disclosure. The term "printing system" as used here encompasses a printer apparatus, including any associated peripheral or modular devices, where the term "printer" as used herein encompasses any apparatus, such as a digital copier, bookmaking machine, facsimile machine, multifunction machine, etc., which performs a print outputting function for any purpose. Marking module 12 includes a charge retentive substrate which could be a photoreceptor belt 14 that advances in the direction of arrow 16 through the various processing stations around the path of belt 14. Charger 18 charges an area of belt 14 to a relatively high, substantially uniform potential. Next, the charged area of belt 14 passes laser 20 to expose selected areas of belt 14 to a pattern of light, to discharge selected areas to produce an electrostatic latent image. Next, the illuminated area of the belt passes developer unit M, which deposits magenta toner on charged areas of the belt.

Subsequently, charger 22 charges the area of belt 14 to a relatively high, substantially uniform potential. Next, the charged area of belt 14 passes laser 24 to expose selected areas of belt 14 to a pattern of light, to discharge selected areas to produce an electrostatic latent image. Next, the illuminated area of the belt passes developer unit Y, which deposits yellow toner on charged areas of the belt.

Subsequently, charger 26 charges the area of belt 14 to a relatively high, substantially uniform potential. Next, the charged area of belt 14 passes laser 28 to expose selected areas of belt 14 to a pattern of light, to discharge selected areas to produce an electrostatic latent image. Next, the illuminated area of the belt passes developer unit C, which deposits cyan toner on charged areas of the belt.

Subsequently, charger 30 charges the area of belt 14 to a relatively high, substantially uniform potential. Next, the charged area of belt 14 passes laser 32 to expose selected areas of belt 14 to a pattern of light, to discharge selected areas to produce an electrostatic latent image. Next, the illuminated area of the belt passes developer unit K, which deposits black toner on charged areas of the belt.

As a result of the processing described above, a full color toner image is now moving on belt 14. In synchronism with the movement of the image on belt 14, a conventional registration system receives copy sheets from sheet feeder module 100 and brings the copy sheets into contact with the image on belt 14. Sheet feeder module 100 includes high capacity feeders 102 and 104 having feed heads 110, respectively, that feed sheets from sheet stacks 106 and 108 positioned on media supply trays 107 and 109 and directs them along sheet path 120 to imaging or marking module 12. Additional high capacity media trays could be added to feed sheets along sheet path 120, if desired.

A corotron 34 charges a sheet to tack the sheet to belt 14 and to move the toner from belt 14 to the sheet. Subsequently, detack corotron 36 charges the sheet to an opposite polarity to detack the sheet from belt 14. Prefuser transport 38 moves the sheet to fuser E, which permanently affixes the toner to the sheet with heat and pressure. The sheet then advances to stacker module F, or to duplex loop D.

Cleaner 40 removes toner that may remain on the image area of belt 14. In order to complete duplex copying, duplex loop D feeds sheets back for transfer of a toner powder image to the opposed sides of the sheets. Duplex inverter 90, in duplex loop D, inverts the sheet such that what was the top face of the sheet, on the previous pass through transfer, will be the bottom face on the sheet, on the next pass through transfer. Duplex inverter 90 inverts each sheet such that what was the leading edge of the sheet, on the previous pass through transfer, will be the trailing on the sheet, on the next pass through transfer.

With further reference to FIG. 1 and in accordance with the present disclosure, a simple method and apparatus for maintaining color consistency in printer 10 is disclosed that includes an algorithm and a pre-transfer reflective sensor for recording diffuse and/or specular reflected light from a patch developed on drum or belt photoreceptor substrate 14. As shown, the pre-transfer sensor 33 is a conventional ETAC sensor and is used to send signals back to controller 45. Disclosed is a variable sampling interval to balance the benefit of xerographic process controls regulation with the cost of sampling. This is achieved by augmenting or replacing a fixed sample rate with a "request to sample interrupt" that is triggered by external indicators or actuators. The indicators signal whether or not a significant disturbance has likely acted upon the system since the last control correction. If it is likely that a significant disturbance has acted, then the loop is closed and a sample and actuator update follows.

Although significant disturbances are often the result of toner material state changes that are often correlated with area coverage shifts, sump on residence time, temperature and humidity, the improved algorithm of the present disclosure is not limited to these, but also attempts to predict disturbances that may result because of tribo shifts, due to changes in environment, toner concentration and/or carrier age.

The algorithm is applied to the xerographic process control task of regulating the toner repetition curve and ensuring proper color stability. The main contributors to color variation in the relatively short term are changes in triboelectricity (tribo) and changes in toner age, including the toner age distribution in the sump. If a large enough change in either of these terms is measured or estimated to have occurred, then a control measure and actuation interrupt is requested.

Figure 2:
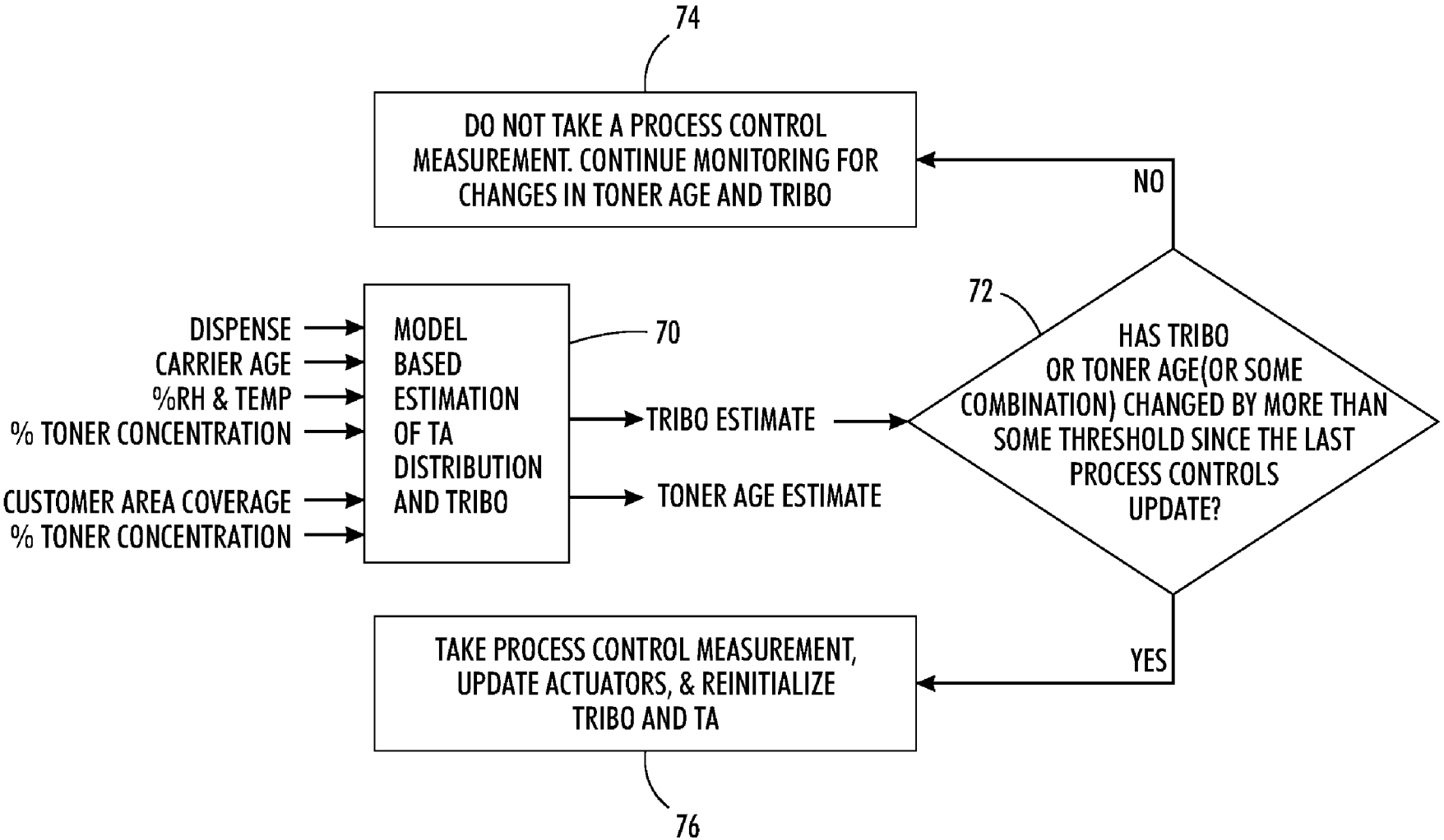
FIG. 2 is a graph showing a sampling determination algorithm used in the xerographic printer of FIG. 1.

For example, as shown in FIG. 2, assume that at some sample time $T_0$ a measurement and an actuator update is made. For illustration sample times are assumed to be integers. At time $T_0$ the toner age $TA(T_0)$ and $Tribo(T_0)$, are estimated and recorded in block 70. At each subsequent time interval $T_0+1$, $T_0+2$, $T_0+3$, $T_0+4$, etc., the toner age and tribo estimates are updated. These estimates are updated via open loop models that may use as inputs the customer area coverage printed, the carrier age CA, the relative humidity % RH, the temperature, and the Toner Concentration sensor outputs. In block 72, if at any future time $T_0+N$, where N is some positive integer, the tribo or toner age, or some combination of the two has changed by more than some predefined threshold(s), then a process control actuation and actuator interrupt is scheduled in block 76. Also, the amount of control actuation needed can be correlated to the estimated change in toner material state (tribo, toner age) and used to adjust the material state function and its threshold value. In this way, the system can be adaptive. Afterwards the process is entirely repeated though now with the new time reference at $T_0+N$. If in block 72 the decision is that the tribo or toner age (or some combination) has not changed by more than some threshold since the last process controls update no process control measurement is taken as shown in block 74.

It should be understood that this measure and actuate scheduling algorithm can coexist with a fixed, though probably infrequent, process controls sampling interval.

In recapitulation, a method and apparatus has been disclosed for maintaining color consistency in a printer that balances the benefit of xerographic process controls regulation with the cost of sampling that includes sampling test patches at variable sampling intervals. The request to sample the test patches is triggered by external indicators, such as, area coverage, carrier age, relative humidity, temperature, and others, if desired, before the developed text patches are expected to go out of range because of the external indicators. A patch measurement is made and the system is controlled back towards its desired set-point. An advantage of this algorithm is the flexibility in balancing the tradeoff between regulation performance and cost of sampling. If external indicators have not changed over a lengthy duration, it is unlikely that an actuation is required.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A process control method for maintaining color consistency in a reprographic device, comprising:

(a) providing a charge retentive surface;

(b) providing toner for developing and image on said charge retentive surface;

(c) providing at least one patch on said charge retentive surface and using said patch for toner measurement and feedback while simultaneously minimizing toner usage;

(d) estimating toner age distribution and tribo of said toner based on predetermined actuators;

(e) determining based on said estimation if tribo or toner age has changed by more than a predetermined threshold since a previous process control update; and (f) if the determination in (e) is NO then continuing to monitor for changes in toner age and tribo without taking a process control measurement and if the determination in (e) is YES then providing a request to sample.

2. The method of claim 1, including providing an optional maximum allowable duration between samples.

3. The method of claim 1, including placing a toner mass onto said at least one patch in response to said request to sample interrupt;

developing said toner mass;

providing a sensor for sensing said developer mass on said at least one patch; and updating said actuators and toner age estimate.

4. The method of claim 3, further including reinitializing said tribo.

5. The method of claim 3, wherein said sensor is an enhanced toner area coverage sensor.

6. The method of claim 3, further providing multiple layers of toner on said at least one patch.

7. The method of claim 6, further providing cleaning said charge retentive surface before placing a toner mass onto said at least one patch.

8. The method of claim 1, wherein said predetermined actuators include carrier age.

9. The method of claim 8, wherein said predetermined actuators include percentage of relative humidity and temperature.

10. The method of claim 9, wherein said predetermined actuators include percentage of toner concentration.

11. The method of claim 10, wherein said predetermined actuators include customer area coverage.

12. The method of claim 1, including using results from said request to sample interrupt to move said process back towards a desired set-point.

13. The method of claim 1, wherein said charge retentive surface is a photoreceptor.

14. The method of claim 13, wherein said photoreceptor is a belt.

15. The method of claim 1, including adjusting time between samples to save toner.

16. A method for maintaining color consistency in a printer, comprising:

(a) providing a charge retentive surface;

(b) providing toner for developing and image on said charge retentive surface;

(c) providing at least one patch on said charge retentive surface and using said patch for toner measurement and feedback while simultaneously minimizing toner usage;

(d) estimating toner age distribution and tribo of said toner based on predetermined actuators;

(e) determining based on said estimation in (d) if tribo or toner age has changed by more than a predetermined threshold since a previous process control update; and (f) if the determination in (e) is NO then continuing to monitor for changes in toner age and tribo without taking a process control measurement and if the determination in (e) is YES then providing a request to sample and take a process control measurement, including;

placing a toner mass onto said at least one patch in response to said request to sample;

developing said toner mass;

providing a sensor for sensing said developer mass on said at least one patch; and updating said actuators and toner age estimate in response to signals from said sensor.

17. The method of claim 16, further including reinitializing said tribo.

18. The method of claim 16, wherein said predetermined actuators include carrier age.

19. The method of claim 16, wherein said predetermined actuators include percentage of relative humidity and temperature.

20. The method of claim 16, wherein said predetermined actuators include percentage of toner concentration.

* * * * *